252-95 AU 166 EX
11/28/78 XR 4,127,496

United States Patent [19]
Stokes

[11] 4,127,496
[45] Nov. 28, 1978

[54] NON-PHOSPHATE AUTOMATIC DISHWASHER DETERGENT

[75] Inventor: Dallas F. Stokes, Metuchen, N.J.

[73] Assignee: Colgate-Palmolive Company, New York, N.Y.

[21] Appl. No.: 767,589

[22] Filed: Feb. 10, 1977

Related U.S. Application Data

[63] Continuation of Ser. No. 589,281, Jun. 23, 1975, abandoned, and Ser. No. 312,045, Dec. 4, 1972, abandoned.

[51] Int. Cl.[2] ..... C11D 7/54
[52] U.S. Cl. ..... 252/102; 252/95; 252/98; 252/99; 252/103

[58] Field of Search ..... 252/95, 98, 99, 102, 252/103

[56] References Cited

U.S. PATENT DOCUMENTS 3,691,082 9/1972 Stimberg et al. ..... 252/98

*Primary Examiner*—Mayer Weinblatt
*Attorney, Agent, or Firm*—Norman Blumenkopf; Herbert S. Sylvester; Murray M. Grill

[57] ABSTRACT

Non-phosphate automatic dishwasher detergent composition comprises an organic non-phosphate sequestering agent, a nonionic detergent, a dry water-soluble anti-spotting agent which liberates hypochlorite chlorine on contact with water, and non-phosphate alkaline and neutral builder salts.

7 Claims, No Drawings

NON-PHOSPHATE AUTOMATIC DISHWASHER DETERGENT

This is a continuation of application Ser. No. 589,281, filed June 23, 1975; and a continuation of Ser. No. 312,045, 12/04/72 both now abandoned.

BACKGROUND OF THE INVENTION

The invention relates to automatic dishwasher detergents containing no phosphate builder salts.

Machine dishwashing is used in connection with practically all commercial and institutional dining facilities as well as in a rapidly increasing proportion of private homes. In commercial machines, the dishes to be washed are introduced into a zone where detergent solution is sprayed over them, the detergent solution being recycled and used repeatedly, and replenished intermittently. In home machines the detergent is used for only one load of dishes and is then discarded, although it, too, is recirculated during the washing operation. Hence in both types of machines, food soil concentrations in the wash solution of 0.05 to 0.1% or higher are considered to be moderate under average conditions.

It has been the practice in formulating machine dishwashing detergents to use primarily various combinations of inorganic sodium and potassium salts, such as polyphosphates, silicates, carbonates, and basic materials such as sodium and potassium hydroxides. It has not been possible to use effective amounts of well-known organic detergents such as the alkyl aryl sulfonates, alkyl sulfonates, alkanol amides, or alkyl aryl polyethers in spray-type mechanical dishwashing detergents because of the foam these materials develop during the washing operation. This foam causes overflow and loss of the wash solution, impairs the mechanical operation of the machine, and lowers the pressure at which the washing fluid is impelled against the utensils to be cleaned. The inorganic materials do not foam themselves, and, at low concentrations of food soil (less than 0.01%), perform satisfactorily in mechanical dishwashers. However, with an increase in food soil concentrations to greater than about 0.03%, foaming becomes a serious problem even with the use of purely inorganic detergent systems. This is because the inorganic detergent systems, being alkaline, can cause some saponification of fatty food soils. This, plus the natural foaming properties of protein food soils, tends to produce foam in the wash tank.

Current automatic dishwasher formulations contain from 10–60% phosphate salts, primarily in the form of polyphosphates and orthophosphates. The phosphates have been found to be highly effective soil removing agents, but are not without disadvantages. Phosphates and phosphate-containing detergent formulations have recently received considerable attention as prime suspects in water pollution. Phosphates are principally alleged to be causative in accelerated eutrification of the nation's waters, and there has recently been an increasing demand for effective detergent compositions which are low in phosphates or, preferably, entirely free of phosphates. With the increased growth of automatic dishwater sales (16% per annum), the demand for a phosphate-free automatic dishwashing composition is particularly great.

SUMMARY OF THE INVENTION

The formulations of the present invention provide a non-phosphate automatic dishwasher detergent that is equal to or superior in cleaning performance to the current phosphate-containing automatic dishwasher detergent formulations. In addition, the non-phosphate detergents of the present invention can be manufactured as cheaply as the phosphate-containing detergents. The present composition is compactable to form the desired density and particle size for maximum efficiency in an automatic dishwasher.

A detergent system for use in automatic dishwashers is required to perform three functions:

(1) soften the water so that detersive action can take place more effectively;

(2) remove the soil from the dishes thoroughly, completely and rapidly; and (3) leave the dish surface in a state where the water drains in a continuous film without breaking into little hanging drops or streams.

Sodium carbonate is commonly employed in automatic dishwasher detergent compositions for its soil-removing properties. In addition, sodium carbonate and sodium lower are effective water-softening agents. These salts are widely used because of their low cost. The carbonates are present in the detergent formulations of the present invention in amounts ranging from about 10% to about 70%, and preferably from about 15% to about 35%.

Highly alkaline dishwashing detergents containing no silicates can attack, etch, and darken aluminum utensils. Some of these formulations also have a destructive action on over-the-glaze dish patterns. Suitable proportions of silicates in the dishwashing formulations help overcome these difficulties. The silicate used in the compositions of the present invention is preferably solid granular sodium metasilicate, a commercially available material. In the broader aspects of the invention, sodium silicates in which the mole ratio of $SiO_2$:$Na_2O$ are more than 1:1, e.g., 2:1 or 3:2:1, may be used in place of the sodium metasilicate. The sodium silicate generally constitutes from about 10% to about 60% of the final composition and preferably from about 20% to 40%.

Organic sequestering agents are used in the detergent compositions of the present invention in place of inorganic phosphate salts. Suitable sequestering agents include the various aminocarboxylates, including ethylenediamine tetraacetates (soluble salts, e.g., Na, K, etc.), nitrilotriacetates, and the like. These sequestering agents are present in amounts ranging from about 10% to about 30%, and preferably from about 15% to 25%.

Other alkaline builder salts and inert neutral salts may be used. These include sodium tetraborate (borax) as a typical alkaline builder, and sodium sulfate and sodium chloride as representative neutral salts. These builder salts make up the balance of the composition.

Recently, certain low foaming organic nonionic detergents have been made available commercially which can be incorporated in small amounts with inorganic non-phosphate materials in automatic dishwasher formulations without seriously increasing their foaming tendency. These nonionic materials add to the detergency of the formulation. Additionally, the nonionic detergent compounds have a pronounced effect of inhibiting foam where heavy food soil loads are present, or in maintaining internal wash pressure at a high level under these conditions.

Wash pressure is defined herein as the pressure registered on a manometer or pressure gauge by a Pitot tube set at the mouth of the wash nozzle. The force of the wash spray against a dish surface is directly proportional to the wash pressure. Since it has been shown that the wash action of the wash spray contributes most to gross soil removal, maintenance of the original wash pressure built into the machine is very important.

Excessive foaming in machine dishwashing has long been a recognized problem and, although billowing foam is an obvious indication of trouble, a real wash pressure problem may exist even without this obvious symptom. For example, an "aerated wash solution," though not so easily detected, may be as serious a problem from the stand point of washing efficiency as billowing foam. An "aerated wash solution" as used herein is defined as a iquid with many small air occlusions or bubbles dispersed in it as contrasted with foam which, as used herein, is defined as a colloidal dispersion of air in liquid floating on top of the wash solution.

As organic wetting agents or detergents it is preferred to use the low-foaming ethylene oxide condensate type of nonionic detergents. Examples thereof are the reaction products of benzyl chloride and ethoxylated alkyl phenol having the formula

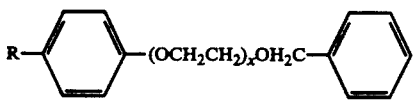

where R is an alkyl chain having from 6 to 12 carbon atoms and X is a whole number from 12 to 20; polyether esters of the formula $$(ClC_6H_4)_2CHCO_2(CH_2CH_2O)_xR$$

where $x$ is an integer from 4 to 20 and R is a lower alkyl group of not over four carbon atoms, e.g., a compound of the formula $$(ClC_6H_4)_2CH—CO_2(CH_2CH_2O)_{15}CH_3$$

and polyalkylene oxide condensates of an alkyl phenol, such as the polyglycol ethers of akyl phenols having an alkyl group of at least about 6 and usually about 8 to 20 carbon atoms and an ethylene oxide ratio (number of ethenoxy groups per mole of condensate) of about 7.5, 8.5, 11.5, 20.5, 30, and the like. The alkyl substituent on the aromatic nucleus may be di-isobutylene, diamyl, polymerized propylene, isooctyl, nonyl, dimerized $C_6$–$C_7$-olefin, and the like. Among other condensates with phenols is an alkylated B-naphthol condensed with 8 moles of ethylene oxide, the alkyl group having 6 to 8 carbon atoms.

Further suitable detergents are the polyoxyalkylene esters of organic acids, such as the higher fatty acids, rosin acids, tall oil, or acids from the oxidation of petroleum, and the like. The polyglycol esters will usually contain from about 8 to about 30 moles of ethylene oxide or its equivalent and about 8 to 22 carbon atoms in the acyl group. Suitable products are refined tall oil condensed with 16 or 20 ethylene oxide groups, or similar polyglycol esters of lauric, stearic, oleic and the like acids.

Additional suitable non-ionic detergents are the polyalkylene oxide condensates with higher fatty acid amides, such as the higher fatty acid primary amides and higher fatty acid mono- and di-ethanol-amides. Suitable agents are coconut fatty acid amide condensed with about 10 to 30 moles of ethylene oxide. The fatty acyl group will similarly have about 8 to 22 carbon atoms, and usually about 10 to 18 carbon atoms in such products. The corresponding suphonamides may also be used if desired.

Other suitable polyether non-ionic detergents are the polyalkylene oxide ethers of higher aliphatic alcohols. Suitable alcohols are those having a hydrophobic character, and preferably 8 to 22 carbon atoms. Examples thereof are iso-octyl, nonyl, decyl, dodecyl, tridecyl, tetradecyl, hexadecyl, octadecyl and oleyl alcohols which may be condensed with an appropriate amount of ethylene oxide, such as at least about 6, and preferably about 10–30 moles. A typical product is tridecyl alcohol, produced by the Oxo process, condensed with about 12, 15 or 20 moles of ethylene oxide. The corresponding higher alkyl mercaptans or thioalcohols condensed with ethylene oxide are also suitable for use in compositions of the present invention.

The water soluble polyoxyethylene condensates with polyoxypropylene polymers may likewise be employed in compositions of the present invention. The polyoxypropylene polymer, which is prepared by condensing propylene oxide with an organic compound containing at least one reactive hydrogen, represents the hydrophobic portion of the molecule, exhibiting sufficient water insolubility per se, at a molecular weight of at least about 900, such as about 900 to 2400, and preferably about 1200 to 1800. The increasing addition or condensation of ethylene oxide on a given water insoluble polyoxypropylene polymer tends to increase its water solubility and raise the melting point such that the products may be water soluble, and normally liquid, paste or solid in physical form. The quantity of ethylene oxide varies with the molecular weight of the hydrophobic unit but will usually be at least about 20% and preferably at least about 40% by weight of the product. With an ethylene oxide content of about 40 up to 50%, there are usually obtained normally liquid products, above 50% soft waxlike products, and from about 70–90% normally solid products may be obtained which can be prepared in flake form if desired. These condensates may be designated by the following structure:

$$Y[(C_3H_6O)_n—E—H]_x$$

where

Y is the residue of an organic compound which contained $x$ active hydrogen atoms.

$n$ is an integer $x$ is an integer, the value of $n$ and $x$ being such that the molecular weight of the compound, exclusive of E, is at least 900, as determined by hydroxy number, E is a polyoxyethylene chain and constitutes 20–90%, by weight of the compound, and H is hydrogen.

It is preferred to use products of the type just described having a total molecular weight within the range 2000 to 10,000, and preferably about 4000 to 8000. A suitable material is a condensate having a typical average molecular weight of about 7500, the hydrophobic polypropylene glycol being condensed with sufficient ethylene oxide until a normally solid water-soluble product is obtained which has an ethylene oxide content of about 80–90% and a melting point usually of about 51°–54° C. Another material is a liquid condensate having an ethylene oxide content of 40–50% and a molecular weight of about 4500.

Typically the nonionic organic detergent may be employed in the instant formulations in amounts from 0.5% up to about 5.0% by weight of the final composition, and preferably about 1.5% by weight thereof. Preferably the detergent used would be characterized by a foam height of less than about 50 mm; in the Ross-Miles pour foam test described by Ross and Miles in "Oil and Soap," May, 1941, pages 99 to 102.

The automatic dishwashing formulations of the present invention contain chlorine-or oxygen-releasing bleaching compounds. The presence of a bleaching compound in an automatic dishwasher detergent composition is desirable for three reasons:

(1) it greatly decreases water spotting of glass and silverware through its improved detergent action;

(2) it provides mild bleaching action and thus prevents stain buildup;

(3) it aids in sanitizing dishware.

Water spotting is reduced as a result of the detergent action of the bleach. On a perfectly clean surface, water will "sheet" evenly, and any minute quantity of dissolved solids will be deposited so evenly over the entire surface that no unsightly spots develop when the rinse water dries. However, when small particles of soil, particularly of the proteinaceous type, remain on the surface, adequate water sheeting is prevented at that area; after the allotted drain time, droplets of water have formed and remain there. As each droplet dries, it leaves behind an amount of dissolved solids sufficient to cause the formation of unsightly spots. It has been postulated that oxidizing bleaches are particularly effective in removing protein-type solids because of the bleaches' ability to oxidize high molecular-weight proteins into simple amino acids which are easily removed by the detergent action of the balance of the washing formula. Thus, in addition to sanitizing, the bleaches contribute to the overall cleaning ability of an automatic dishwashing formulation.

As a suitable anti-spotting agent, it is preferred to use a dry, water-soluble compound which, on contact with water liberates hypochlorite chlorine, i.e., those water-soluble dry solid materials which generate hypochlorite ions on contact with, or dissolution in, water. Examples thereof are the dry, particulate heterocyclic N-chlor imides such as trichlorocyanuric acid, dichlorocyanuric acid, and salts of dichlorocyanuric acid such as sodium dichlorocyanurate and potassium dichlorocyanurate. Other imides may also be used such as N-chlorosuccinimide, N-chloromalonimide, N-chlorophthalimide, and N-chloronaphthalimide. Additional suitable imides are the hydantoins such as 1, 3-dichloro-5, 5-dimethylhydantoin; N-monochloro-5, 5-dimethylhydantoin; methylene-bis(N-chlor-5,5-dimethylhydantoin); 1, 3-dichloro-5-methyl-5-isobutylhydantoin; and the like. Other useful hypochlorite-liberating agents are trichloromelamine and dry, particulate, water-soluble anhydrous inorganic salts such as lithium hypochlorite and calcium hypochlorite.

Oxygen-liberating bleaches that may successfully be used with the compositions of the present invention include sodium and potassium perborates, potassium monopersulfate, and the like.

The anti-spotting bleaching compound is generally employed in an amount on the order of about 0.5 to 5% of the final composition, and preferably of about 2% of the final composition.

As a further ingredient in the formulation, a suitable perfume may be included to give the formulation a pleasant odor. Since most nonionic detergents have some odor, the choice thereof should take into consideration the odor of the nonionic detergent so that it does not unduly conflict with the perfume. Boric acid may be added to the composition to enhance the stability of the perfume.

A quantity of a coloring material may also be considered as yet a further ingredient. For instance, acceptable coloring materials are ultramarine blue and heliogen green, a phthalocyanine green pigment. Naturally, the quantities employed are quite small. Other suitable additives may include small quantities, e.g., 0–2%, of other types of glaze attach inhibitors such as compatible proportions of sodium berylliate, aluminum acetate, sodium aluminate, and the like.

The solid materials utilized desirably should be granular, preferably having a mesh size of approximately the same size (and within the range of about 0.074 to 0.84 mm.) in order to prevent stratification. In formulating the detergent compositions, it is important that all the ingredients be kept as dry as possible prior to mixing. The ingredients should preferably be of anhydrous grade taken from sealed containers and charged directly to a mixer.

DESCRIPTION OF THE PREFERRED EMBODIMENTS

Example I

In this example there is used a dry mixture of the following pre-blends:

| Pre-blend A | Percent by Weight |
|---|---|
| anhydrous sodium metasilicate | 24.1 |
| anhydrous sodium sulfate | 18.5 |
| sodium carbonate | 18.5 |
| sodium tetraborate pentahydrate | 18.5 |
| sodium chloride | 3.7 |
| nitrilotriacetic acid | 16.7 |
| **Pre-blend B** | **Percent by Weight** |
| nonionic detergent* | 73.2 |
| water | 14.6 |
| detergent perfume | 7.3 |
| hydrated chrome oxide green pigment | 4.9 |
| **Pre-blend C** | **Percent by Weight** |
| Potassium dichloroisocyanurate | 25.0 |
| Anhydrous sodium sulfate | 56.3 |
| Sodium tetraborate pentahydrate | 18.7 |

*The nonionic detergent is the product obtained by the condensation of about three moles of propylene oxide with the condensation product of one mole of a mixture of essentially straight chain, primary, fatty alcohols in the $C_{10}$–$C_{18}$ range with about six moles of ethylene oxide.

The mixture is prepared from 90% Pre-blend A, 2% Pre-blend B, and 8% Pre-blend C. Pre-blend A is mixed for three minutes in a twin shell mixer, after which Pre-blend B is added and mixed for two minutes. Pre-blend C is added last, and the total is mixed for three minutes. The resulting fine particle mixture is compacted at a 1000–2000 pound load, broken up, and screened through a 10 and 40 mesh screen. The density of the finished product was 0.92; it had a pH of 11.4.

The formulation is a free-flowing powder that does not become tacky and does not lose its free-flowing property even after storage for 7 days at 140° F. In tests in an automatic dishwasher, using the formulation in 0.15% concentration in the water, it shows excellent dishwashing characteristics with no damage to the overglaze of china.

EXAMPLE II

In this example there is used a dry mixture of the following pre-blends:

| Pre-blend A | Percent by Weight |
|---|---|
| Anhydrous sodium metasilicate | 24.1 |
| Boric acid | 8.0 |
| Sodium carbonate | 14.2 |
| Anhydrous sodium sulfate | 18.5 |
| Sodium tetraborate pentahydrate | 18.5 |
| Nitrilotriacetic acid | 16.7 |
| **Pre-blend B** | **Percent bt Weight** |
| Nonionic detergent* | 73.2 |
| Water | 14.6 |
| Detergent perfume | 7.3 |
| Hydrated chrome oxide green pigment | 4.9 |
| **Pre-blend C** | **Percent by Weight** |
| Potassium dichloroisocyanurate | 25.0 |
| Anhydrous sodium sulfate | 56.2 |
| Sodium tetraborate pentahydrate | 18.8 |

*The nonionic detergent is the product obtained by the condensation of about three moles of propylene oxide with the condensation product of one mole of a mixture of essentially straight chain, primary, fatty alcohols in the $C_{10}$–$C_{18}$ range with about six moles of ethylene oxide.

The mixture is prepared from 90% Pre-blend A, 2% Pre-blend B, and 8% Pre-blend C. Pre-blend A is mixed for three minutes in a twin shell mixture, after which Pre-blend B is added and mixed for 2 minutes. Pre-blend C is added last, and the total is mixed for three minutes. The resulting fine particle mixture is compacted at a 1000–2000 pound load, broken up, and screened to the desired particle size.

What is claimed is:

1. A water-soluble machine dishwashing detergent devoid of phosphate builder consisting essentially of:
   (a) from about 10 to 30% of an organic sequestering agent selected from the group consisting of tetrasodium ethylene diamine tetracetate and nitrilotriacetic acid;
   (b) from about 0.5 to 5% of a dry water-soluble anti-spotting bleaching agent selected from the group consisting of heterocyclic N-chlorimides, trichloromelamine, lithium hypochlorite, calcium hypochlorite, sodium perborate, potassium perborate and potassium monopersulfate;
   (c) from about 0.5 to 5% of a water-soluble ethylene oxide condensed nonionic detergent; and
   (d) from about 10 to 70% sodium carbonate or sequicarbonate, about 10 to 60% of a water-soluble sodium silicate having a $SiO_2$ to $Na_2O$ mole ratio of from 1:1 to 3.2:1 and from 0 to 69% of a builder selected from the group consisting of borax, sodium sulphate, sodium chloride and mixtures thereof all percents by weight.

2. The water-soluble machine dishwashing detergent composition of claim 1 wherein the builder salts are sodium carbonate and sodium metasilicate.

3. The water-soluble machine dishwashing detergent of claim 1 wherein the nonionic detergent is the product obtained by the condensation of 3 moles of propylene oxide with the condensation product of 1 mole of a mixture of straight chain, primary fatty alcohols having from 10 to 18 carbon atoms with 6 moles of ethylene oxide.

4. The water-soluble machine dishwashing detergent of claim 1 wherein builder (d) is a mixture of sodium carbonate, sodium tetraborate pentahydrate, anhydrous sodium metasilicate, sodium chloride and anhydrous sodium sulfate.

5. The water-soluble machine dishwashing detergent of claim 1 wherein said nonionic detergent (c) is selected from the group consisting of reaction products of benzyl chloride and ethoxylated alkyl phenol having the formula

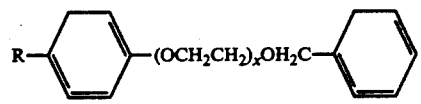

where R is an alkyl chain having from 6 to 12 carbon atoms and $x$ is a whole number from 12 to 20; polyether esters of the formula $$(C\,C_6H_4)_2CHCO_2(CH_2CH_2O)_xR$$

where $x$ is an integer from 4 to 20 and R is a ower alkyl group of not over 4 carbon atoms; and polyalkylene oxide condensates of an alkyl phenol, said alkyl containing from about 6 to 20 carbon atoms and wherein the number of ethenoxy groups per mole of condensate is at least about 7.5.

6. The water-soluble machine dishwashing detergent of claim 1 wherein the water-soluble silicate builder salts are selected from sodium metasilicate and sodium silicates wherein the mole ration of $SiO_2$:$Na_2O$ are more than 1:1.

7. The machine dishwashing detergent of claim 6 wherein the anti-spotting bleaching agent is potassium dichloroisocyanurate.

* * * * *